United States Patent [19]

Wallis et al.

[11] 3,930,488

[45] Jan. 6, 1976

[54] HEATING PANEL FOR USE IN EXPLOSION-PRONE FURNACES

[75] Inventors: János Wallis, Budapest, Hungary; Horst Hammecke, Darmstadt-Eberstadt, Germany

[73] Assignees: Licencia Talalmanyokat Ertekesito Vallalat, Budapest, Hungary; Eltra KG Leicht und Trambauer, Pfungstadt, Germany

[22] Filed: Oct. 24, 1974

[21] Appl. No.: 517,604

[30] Foreign Application Priority Data

Nov. 2, 1973 Hungary ..... LI 248

[52] U.S. Cl. ..... 126/92 B; 13/25; 126/92 C; 219/405

[51] Int. Cl.[2] ..... F24C 3/04

[58] Field of Search ..... 126/92 R, 92 C, 92 AC, 126/92 B, 92 A; 110/1 A; 431/328; 432/175; 13/22, 25, 31; 219/405

[56] References Cited

UNITED STATES PATENTS

| | | | |
|---|---|---|---|
| 2,963,529 | 12/1960 | Schmidt | 13/25 |
| 3,197,185 | 7/1965 | Beattie | 219/405 |
| R24,296 | 3/1957 | Stewart | 219/405 |

*Primary Examiner*—John J. Camby
*Assistant Examiner*—Henry C. Yuen
*Attorney, Agent, or Firm*—Young & Thompson

[57] ABSTRACT

A heating panel for use in explosion-prone furnaces comprises a heating element on the inner side thereof, and on the outer side of the heating element a series of spaced parallel sheets of aluminum foil which, in the case of an explosion, simply blow out and are easily replaceable. The panel is rectangular and bordered with insulating material and it is contemplated that a plurality of the panels can be assembled in side-by-side relationship. The heating element may be electrical or run on gas or oil.

5 Claims, 4 Drawing Figures

HEATING PANEL FOR USE IN EXPLOSION-PRONE FURNACES

The present invention relates to a heating panel, especially to a heating panel for furnaces with explosion-prone inner chambers.

Furnaces of various purposes and various structures are widely known. These furnaces consist generally of a frame structure, of double-walled sheeting as well as of heating bodies, e.g. elements emitting infrared rays mounted thereon. The double wall of the sheeting is filled with heat-insulating material. As experience proves, a furnace of given dimensions can be economically used for the treatment (e.g. for drying) of products within certain dimension limits only. In the case of parts produced in smaller quantities, however, if no furnace of suitable dimensions is available, the production of new equipment is uneconomical, but the sale of the old equipment is difficult, just due to the individual size thereof. If the size of the workpiece to be treated is smaller than required, the possibility of a more profitable comprises arises to operate unnecessarily large equipment, that is to reduce the utilization factor. If, however, the size of the workpiece is too large, obviously new equipment is required. With the present rapid technical development, the products have even shorter time to be on the market, therefore constantly new furnaces are required. The establishment of furnaces with the conventional engineering is an expensive and lengthy procedure. Also the transport in full or in part of the conventional furnaces is difficult and can be often carried out with particular vehicles only.

A further significant drawback of the known furnaces with closed chambers consists in that when treating explosive materials, an explosion may cause both casualties and damages.

Moreover with furnaces of large height the uniform temperature of the inner chamber cannot be provided for, although this would be in most cases necessary or advantageous.

The inner sides of the furnace walls are covered with bright reflecting sheets in order to achieve a heating of higher efficiency. These sheets will be obscured after a constant operation for 6 to 8 months. Their regular cleaning is practically impossible, their repolishing is expensive and lengthy, whereas their replacement can generally be effected only by removing the furnace wall.

The aim of the invention is the elimination of the above drawbacks of furnaces.

Another object of the invention is the production of heating panels, which are fully closed, but which open in case of explosion and which enable furnaces of optional dimensions and shape to be quickly assembled and disassembled, in which the reflecting elements can be easily, quickly and inexpensively replaced and in which after an explosion, the furnace can be restored in a short while.

In the solution of these problems according to the invention the heating panel consists of one or more frames, of one or more heating bodies fastened to the frames, of connecting elements joining the heating bodies with the power source, as well as of external over plates, and it is provided with heat insulation, further it has outer and inner boxes in one of which one or more foils closing the inner chamber of the furnace are extended and the heating panel has an open orifice or one closed by a foil in the part beyond the outermost foil.

The side towards the inner chamber of the furnace of the innermost foil has expediently a bright surface. The foils are made advantageously of aluminum. The heating bodies are expediently infrared radiating elements. In the case of a radiating furnace the side towards the inner chamber of the furnace of the heating panel is advantageously open, the foils are extended in the inner box and the heating bodies are arranged inwardly from the innermost foil.

In case of a furnace of air circulation system, the side towards the inner chamber of the furnace of the heating panel is expediently closed with a sheet, the heating bodies are arranged in the inner box, whereas the foils are in the outer box, the innermost foil being expediently spanned between two wire meshes and the inner box having orifices communicating with the adjacent heating panels. The frames are advantageously made of channel sections bent to rectangular shape.

The invention now will be described on the basis of embodiments shown in the enclosed drawings, wherein FIG. 1 is a somewhat schematic cross-sectional view of a heating panel for furnaces of the radiating type provided with vertically arranged heating bodies;

The heating panels shown as examples consist of two frames 1 each made of channel sections bent to rectangular shape. The frames 1 are secured together side by side (e.g. by screws). In the position according to the figures, the inner chamber of the furnace is arranged to the right and the exterior to the left of the heating panel. The two frames 1 determine outer 6 and inner 6' boxes.

Figure 1:
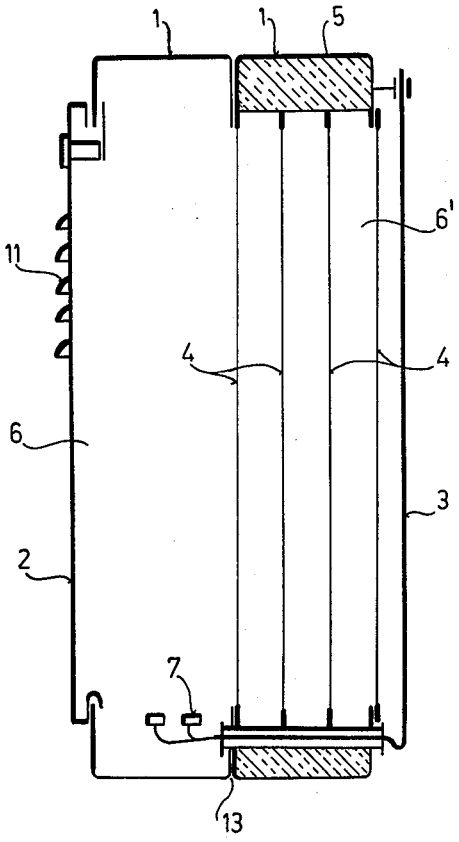
Figure 2:
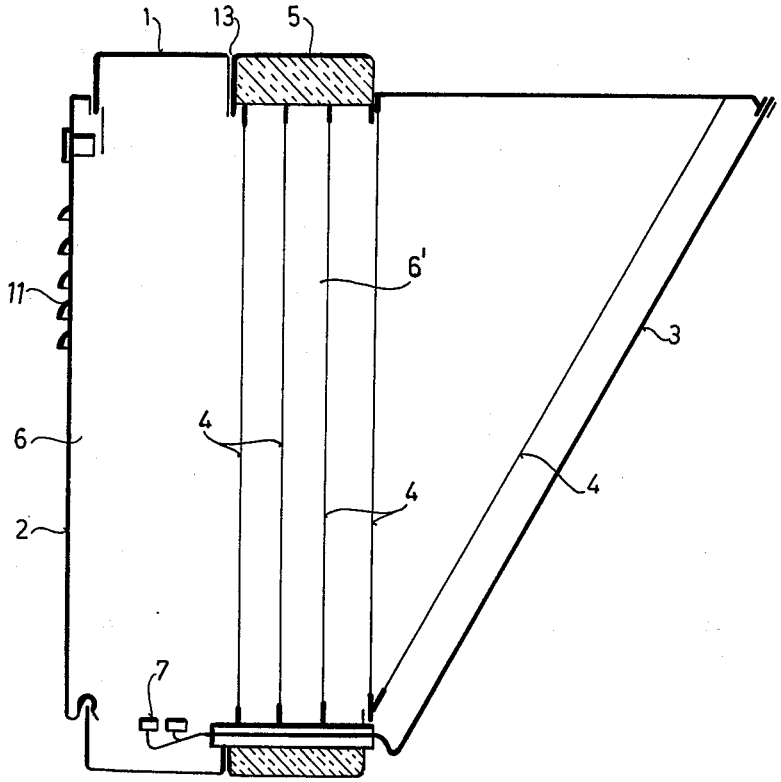
FIG. 2 is the same, provided with a heating body in a slant position.
Figure 3:
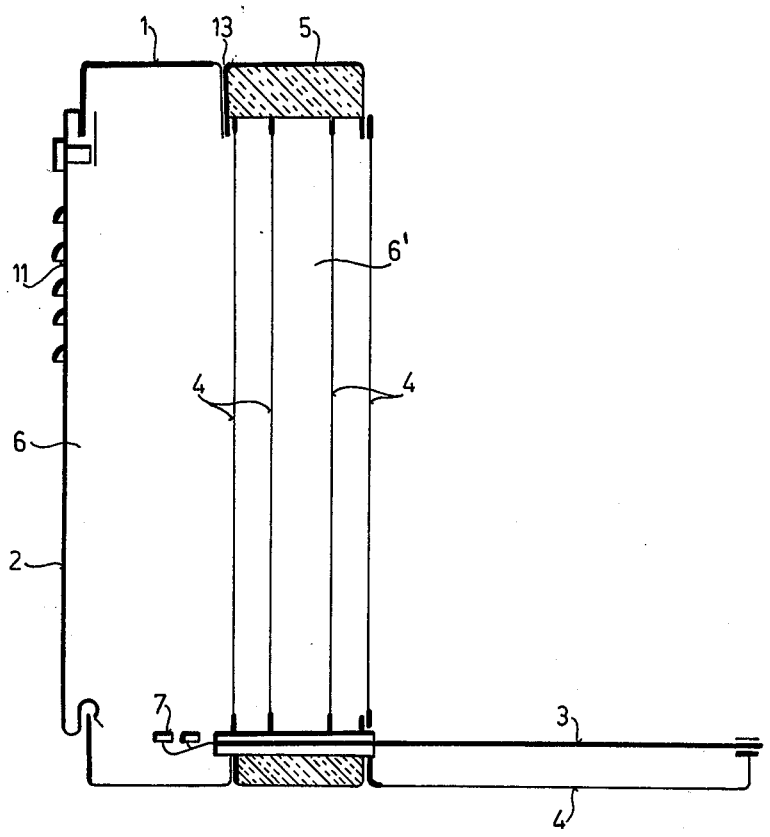
FIG. 3 is the same, provided with a horizontally arranged heating body.

With heating panels of the radiating type shown in FIGS. 1 to 3 the inner box 6' is provided with encircling heat insulation 5 and on its side towards the inner chamber of the furnace (further on: inner side) heating body 3 is arranged which is e.g. an element emitting infrared rays, operating with power which maybe gas, oil or electric power. The heating bodies 3 can be arranged, as circumstances require, vertically (FIG. 1), obliquely (FIG. 2) and horizontally (FIG. 3) and are connected to the suitable power source by means of junction element 7. The outer box 6 is closed by a cover plate 2, provided with orifices 11. On the entire surface not covered with heat insulation 5 foils 4 are extended made expediently of aluminum. The innermost foil 4 constitutes partly a reflecting surface behind the heating body 3 and partly it insulates — together with the other foils 4 and the enclosed air layers. At the same time, the foils 4 operate in case of an explosion as safety closing elements, since under the effect of an overpressure, they quickly spring and ensure an oriented blowing through the outer box and the orifice 11. The foils 4 can be easily and quickly replaced when obscured due to the use for a longer time or when sprung due to an explosion and the furnace assembled of heating panels is again ready for service.

At the connection point of the two frames 1 a round running channel 13 is developed in which a seal (not shown) can be arranged. After the fitting of the adjacent heating panels and the drawing of the joint element combining the panels, respectively, the seal provides for the gas tightness of the joint.

Figure 4:
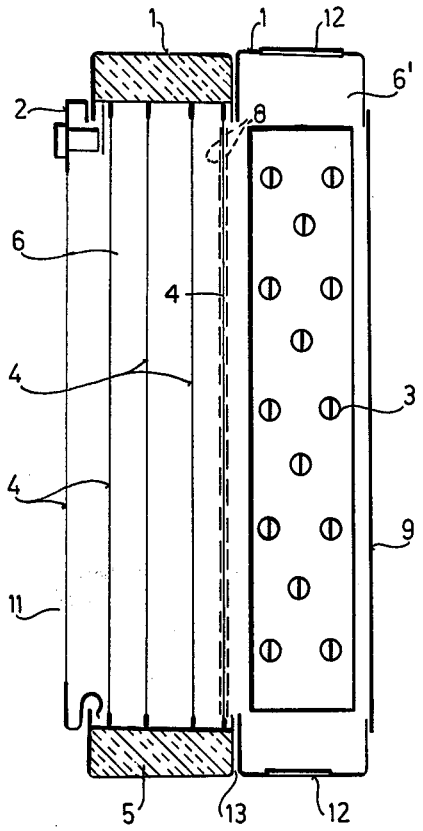
FIG. 4 shows a heating panel for furnaces having an air-circulation system.

The heating panel of the air-circulation system according to FIG. 4 differs from those described above in that the inner side of the inner box 6' is covered with a sheet 9, the heating bodies are arranged in the inner box 6', on the frame 1 of which orifices 12 communicating with the adjacent heating panels are provided. The heat insulation 5, as well as the foils 4 are arranged in the outer box 6 and the orifice 11 on the cover plate 2 is similarly covered with foil 4. The innermost foil 4 is fixed between two wires meshes 8 in order to avoid its being sprung under the effect of the overpressure (which insignificant, of course, as compared to that of an explosion) produced by means of a fan (not shown) in order to ensure air circulation. In case of an explosion, the foils 4 release the overpressure in the above described manner.

Furnaces of optional dimension and shape can be developed with the heating panels according to the invention. The size and weight of the panels may be relatively low, facilitating their delivery and the assembly. The used foils — in addition to their ability of preventing catastrophe in case of an explosion — provide for excellent reflecting surfaces and good heat insulation. The foil itself is cheap, and it can be easily and quickly replaced, if necessary. Since individual heating bodies are provided for each heating panel (which can be mounted in advance in the workshop and nothing but their connection to the power source is required on the site), they can be individually controlled, thus uniform temperature can be achieved in the entire furnace.

What we claim is:

1. A heating panel, particularly for explosion-prone furnaces, comprising a frame of substantially rectangular shape, at least one heating element secured to the frame on the inner side thereof, means to supply power to said heating element, and at least one rectangular sheet of aluminum foil having edges and extending across and surrounded edgewise by the frame on the outer side of the heating element, whereby said foil blows out under the effect of substantial overpressure, said foil having a shiny reflective surface on its side adjacent said heating element there being a plurality of said foils in parallel spaced apart relationship in said frame.

2. A heating panel as claimed in claim 1, and heat insulation disposed about the periphery of said frame.

3. A heating panel as claimed in claim 1, said heating element being of the infra-red type. 9

4. A heating panel as claimed in claim 1, and a cover plate on the outer side of said panel, said cover plate having at least one orifice therein.

5. A heating panel as claimed in claim 4, said at least one orifice being closed by a sheet of aluminum foil.

* * * * *